US006843068B1

(12) United States Patent
Wacker

(10) Patent No.: US 6,843,068 B1
(45) Date of Patent: Jan. 18, 2005

(54) METHOD AND APPARATUS FOR ADJUSTING THE TEMPERATURE SET POINT BASED ON HUMIDITY LEVEL FOR INCREASED COMFORT

(75) Inventor: Paul C. Wacker, Plymouth, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/627,113

(22) Filed: Jul. 25, 2003

(51) Int. Cl.[7] ..... F25B 49/00; F25D 17/04

(52) U.S. Cl. ..... 62/176.6; 62/157; 165/223; 165/237; 165/267; 236/44 C

(58) Field of Search ..... 62/157, 176.1, 62/231; 165/222, 223, 237, 238, 239, 267; 236/44 C, 46 R

(56) References Cited

U.S. PATENT DOCUMENTS 4,655,279 A 4/1987 Harmon, Jr.
4,771,392 A * 9/1988 Hall ..... 700/278
4,967,382 A * 10/1990 Hall ..... 700/278
6,070,110 A * 5/2000 Shah et al. ..... 700/278
6,079,121 A 6/2000 Khadkikar et al.
6,216,956 B1 4/2001 Ehlers et al.
6,295,823 B1 * 10/2001 Odom et al. ..... 62/176.6
6,478,084 B1 11/2002 Kumar et al.
6,536,675 B1 * 3/2003 Pesko et al. ..... 236/47
2001/0020644 A1 9/2001 Guthier et al.

* cited by examiner

*Primary Examiner*—Marc Norman

(57) ABSTRACT

Methods and apparatus for using humidity level to adjust the temperature set point of an HVAC system for increased occupant comfort. In one illustrative embodiment, the temperature set point for the inside space is moved downward when the humidity of the inside space rises above a predetermined humidity set point threshold value. In warm climates, this causes the air conditioner of the HVAC system to be activated, which lowers the temperature of the inside space to a new lower temperature set point. In some embodiments, the HVAC system retains the new lower temperature set point for a predetermined time period. The predetermined time period may be dependent on a number of factors, including whether the space is expected to occupied or unoccupied.

21 Claims, 3 Drawing Sheets

METHOD AND APPARATUS FOR ADJUSTING THE TEMPERATURE SET POINT BASED ON HUMIDITY LEVEL FOR INCREASED COMFORT

The present invention generally relates to the field of heating, ventilation, and air conditioning (HVAC), and more particularly to temperature set point control based on humidity for increased comfort.

BACKGROUND

HVAC systems are commonly used to control the temperature of the inside space of a building or other structure. Many HVAC systems do not attempt to control humidity, even though humidity can play a significant role in occupant comfort. For many residential and commercial HVAC systems, humidity is reduced as merely a byproduct of operating the cooling system. While HVAC systems have long been adapted to use temperature as the standard for determining when to provide heating or cooling, new strategies are needed to incorporate humidity effects on perceived comfort.

SUMMARY

The present invention provides methods and apparatus for using humidity level to adjust the temperature set point of an HVAC system for increased occupant comfort. In one illustrative embodiment, the temperature set point for the inside space is moved downward when the humidity of the inside space rises above a predetermined humidity set point threshold value. In warm climates, this causes the air conditioner of the HVAC system to be activated, which lowers the temperature of the inside space to a new lower temperature set point. In some embodiments, the HVAC system retains the new lower temperature set point for a predetermined time period. The predetermined time period may be dependent on a number of factors, including whether the space is expected to occupied or unoccupied.

When the space is expected to be unoccupied, and occupant comfort is less of a concern, the temperature set point may be allowed to return to the previous higher set point value after a relatively short time period. A relatively short time period can be used because relatively short term temperature cycling in the inside space is less of a concern when no occupants are present, and maintaining a lower temperature set point value for a longer time period may consume additional energy. When the space is occupied, however, and occupant comfort is more of a concern, the temperature set point may remain at the new lower temperature set point for a longer period of time. The longer predetermined time period may help reduce relatively short term temperature cycling in the inside space, which under some circumstances, may be noticeable and somewhat uncomfortable for occupants in the inside space. In addition, the use of a lower temperature set point during periods of high humidity may create better perceived comfort for occupants. In some embodiments, the humidity level may correspond to a relative humidity level. However, any suitable measure of humidity may be used, as desired.

DETAILED DESCRIPTION

The following detailed description should be read with reference to the drawings. The drawings, which are not necessarily to scale, depict illustrative embodiments and are not intended to limit the scope of the invention.

The present invention creates conditions within an inside space which are more comfortable for occupants by reducing the set point temperature when humidity is high. In addition, by reducing the temperature when the humidity is high, the supporting air conditioner may run for longer periods of time to maintain the reduced temperature set point, which can remove additional water from the inside space.

Figure 1:
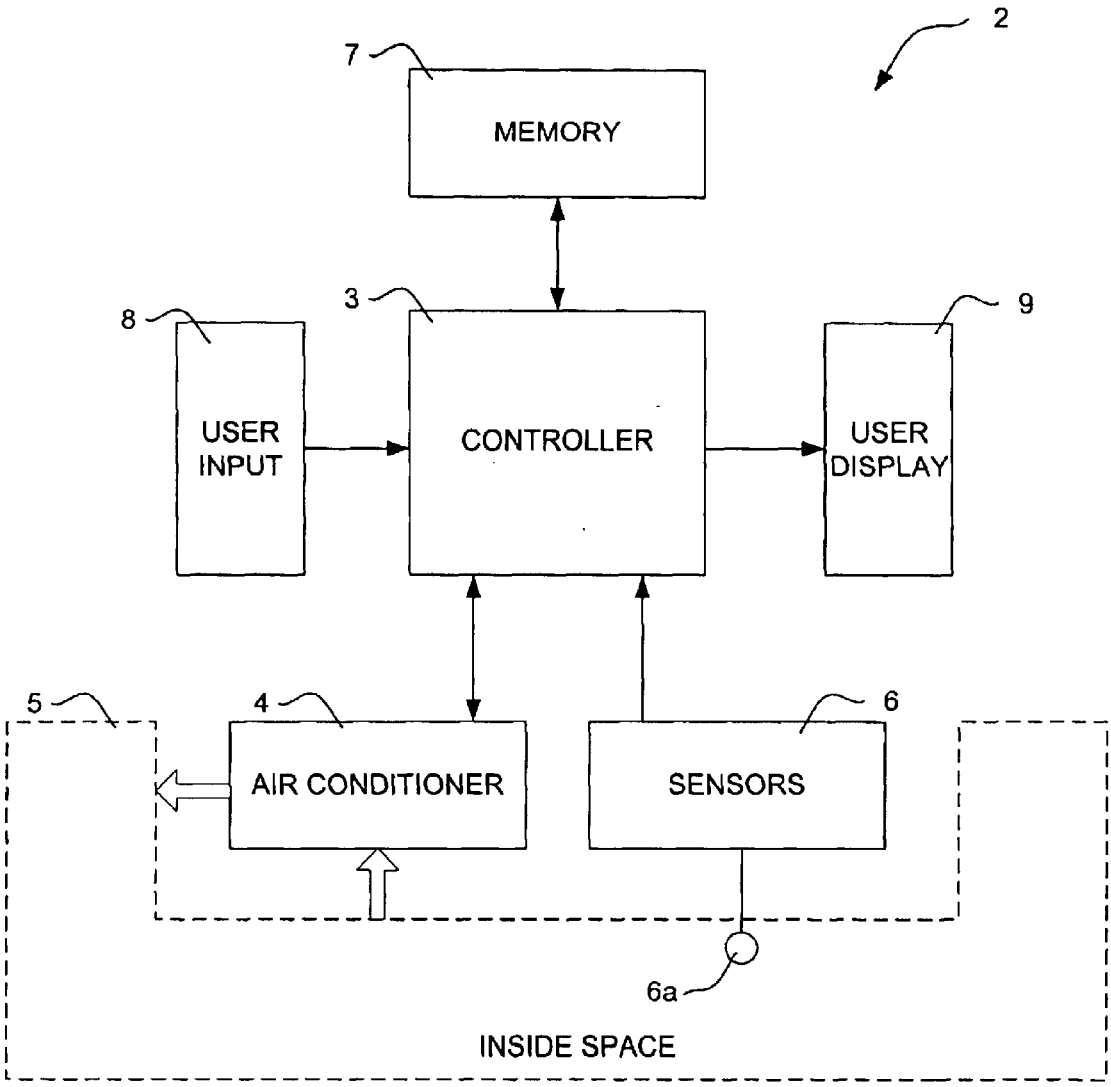
FIG. 1 is a block diagram of an illustrative system for controlling an air conditioner in accordance with the present invention.

FIG. 1 is a block diagram of an illustrative system for controlling an air conditioner in accordance with the present invention. The system is generally shown at 2, and includes a controller 3 for controlling an air conditioner 4 that is adapted to service an inside space 5. The controller 3 is preferably a microprocessor that is controlled by software stored in memory 7. However, it is contemplated that controller 3 may be any suitable controller, depending on the application. One or more sensors 6 preferably provide sensor signals to the controller 3 related to one or more environmental conditions of the inside space 5. One particular sensor is shown at 6*a*, which may be a humidity sensor. Other sensors may include, for example, temperature sensors, gas sensors, etc. The controller 3 may provide control signals to air conditioner 4 to control various preselected environment conditions in the inside space 5, such as temperature, humidity, etc.

As indicated above, memory 7 may store a computer program that is executed by controller 3. Memory 7 may be, for example, Random Access Memory, Read-Only-Memory, Read/Writable Non-Volatile memory, magnetic media, compact disk, or any other suitable data storage medium. In one embodiment, memory 7 includes both Random Access Memory and Read/Writable Non-Volatile memory.

In some embodiments, a user interface 8 is coupled to the controller 3. The user interface may allow a user to enter/change set points, schedules, and other control parameters. In some illustrative embodiments, the control parameters include, for example, temperature set points, humidity set points, upper and lower humidity threshold values, when the space is expected to be occupied and unoccupied, etc. Some or all of the control parameters may be stored in memory 7, if desired. A user display 9 may be coupled to the controller 3 to display information to the user. This information may include, for example, set points, schedules, other control parameters, and/or any other information that may be useful or informative to the user.

In one illustrative embodiment, the controller 3 reads a temperature set point for the inside space from the memory 7, and in some cases an indication of whether the inside space is either expected to be occupied or unoccupied based on a schedule, or actually occupied or unoccupied based on an occupancy sensor. A measure of the humidity level in the inside space 5 may be read by a humidity sensor 6*a*, and provided to controller 3. The controller may then determine if the humidity level of the inside space has risen above an upper humidity threshold level, which may also be stored in memory 7. The controller may then lower the current temperature set point for a first time period if the inside space is expected to be unoccupied, and lower the current temperature set point for a second time period if the inside space is expected to be occupied. Preferably, the first time period is shorter than the second time period, but this may not be required in all embodiments. The temperature set point is preferably used to control the air conditioner 4 such that the temperature in the inside space 5 is maintained at the temperature set point.

Figure 2:
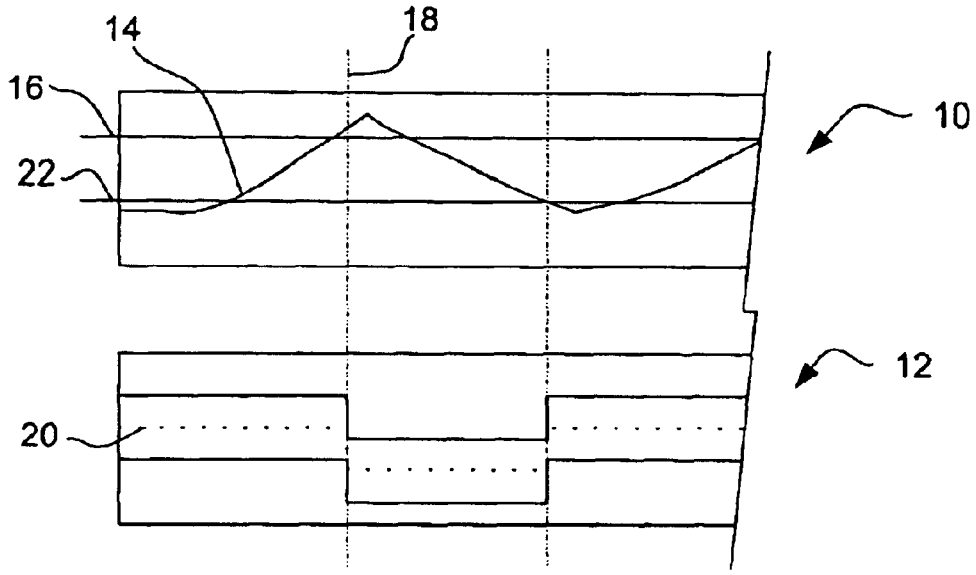
FIG. 2 is a graph illustrating set points as modified in response to changes in measured or sensed humidity.

FIG. 2 a graph illustrating a temperature set point 12 as modified in response to changes in measured or sensed humidity 10 in an inside space, such as inside space 5 of FIG. 1. In one illustrative embodiment, the temperature set point 12 can be modified in response to a sensed humidity level 10. In the example shown in FIG. 2, when the humidity level 10 represented by trace 14, passes an upper humidity threshold value 16 at time 18, the temperature set point 20 moves to a lower temperature set point value. The temperature set point 20 is illustrated as a dashed line, with two dark parallel lines on either side. The dark parallel lines represent a region of hysteresis, sometimes referred to as a dead zone, around the temperature set point value. After the humidity reaches the upper humidity threshold temperature value 16, the humidity trace 14 may continue to rise for some time, after the temperature set point 20 has been lowered. This may be particularly true when the humidity trace 14 corresponds to relative humidity, because the initial reduction in air temperature produced by the air conditioner may cause an increase in relative humidity unless and until moisture can be removed from the air. The humidity trace 14 eventually may begin to drop as shown because of the effects the air conditioner has on removing moisture from the air, unless there is a significant infusion of moisture into the controlled space.

For the illustrative embodiment shown in FIG. 2, and after the humidity trace 14 crosses a lower humidity threshold 22, the temperature set point 18 returns to its original level. The separation between the upper humidity threshold 16 and the lower humidity threshold 22 for the humidity curve 10 is preferably provided to gain some degree of hysteresis in the system.

The disruption of normal air conditioning equipment cycling caused by the thermostat controlling to a new set point can itself cause discomfort to occupants. Therefore changing of the temperature set point should be minimized during occupied times since it could cancel the comfort afforded by a lower temperature set point to offset higher humidity.

Figure 3:
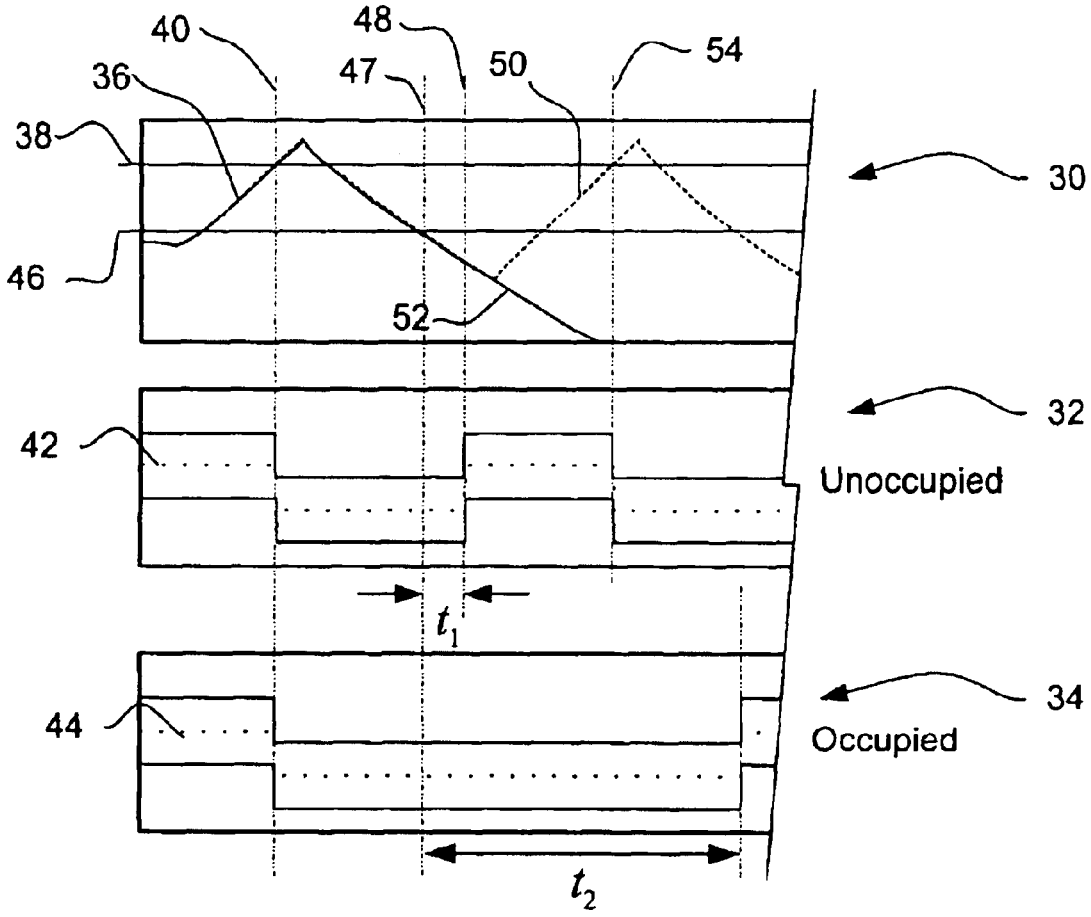
FIG. 3 is a graph illustrating set points as modified in response to changes in measured or sensed relative humidity depending on whether the controlled space is occupied or unoccupied.

FIG. 3 illustrates an approach to help reduce quick cycling of an HVAC system of an occupied space, while helping to prevent unnecessary overcooling of an unoccupied space. FIG. 3 is a graph illustrating temperature set points as modified in response to changes in measured or sensed humidity, depending on whether the controlled space is occupied or unoccupied. Included in FIG. 3 is a graph 30 representing the humidity level in the inside space, a graph 32 representing the unoccupied temperature set points, and a graph 34 representing the occupied temperature set points. The humidity graph generally shown at 30 includes a humidity trace 36, which can be seen to cross an upper humidity threshold 38 at time 40. In such an event, if the space is unoccupied, the illustrative embodiment responds by lowering the unoccupied temperature set point 42, shown in the unoccupied temperature set point graph 32. If the space is occupied, the illustrative embodiment responds by lowering the occupied temperature set point 44, shown in the occupied temperature set point graph 34. Lowering the temperature set point will tend to increase occupant comfort during a higher humidity level 36 of the inside space.

After the humidity level 36 crosses the lower humidity threshold 46, as shown at time 47, the unoccupied temperature set point 42 remains at the lower temperature set point value for a predetermined time period $t_0$. In contrast, the occupied temperature set point 44 remains at the lower temperature set point value for a predetermined longer time period $t_2$, where $t_2$ is greater than $t_0$.

As can be seen, when the inside space is expected to be unoccupied, and occupant comfort is less of a concern, the lower temperature set point may return to the previous higher temperature set point value a relatively short time (e.g. $t_0$) after the humidity level reaches the predetermined lower threshold value. A relatively short time period (e.g. $t_1$) may be chosen because relatively short term temperature cycling in the inside space is less of a concern when no occupants are present, and maintaining a lower temperature set point value for a longer time period may consume additional energy.

When the space is expected to be occupied, however, and occupant comfort is more of a concern, the lower temperature set point may return to the previous higher temperature set point value a longer time period (e.g. $t_2$) after the humidity reaches the predetermined lower threshold value. The relatively longer time period (e.g. $t_2$) may help reduce relatively short term temperature cycling in the inside space, which under some circumstances, may be noticeable and somewhat uncomfortable for some occupants in the inside space. In addition, use of a lower temperature set point for a longer period of time (e.g. $t_2$) during periods of relatively higher humidity may create better perceived comfort for the occupants. In some embodiments, the humidity level may correspond to relative humidity. However, any suitable measure of humidity may be used, as desired.

The shorter unoccupied predetermined period of time (e.g. $t_1$) is preferably greater than or equal to zero, but less than the longer occupied predetermined period of time (e.g. $t_2$). In some embodiments, the longer predetermined occupied period of time (e.g. $t_2$) is chosen to correspond roughly to a typical air conditioner cycle, such as twenty minutes (e.g. compressor on for ten minutes and off for ten minutes), to allow for the completion of approximately one full air conditioner cycle once the humidity level reaches the predetermined lower humidity threshold value. This may help dampen the control effects of the space air temperature changes from the equipment cycling as the thermostat controls the dry bulb temperature and also other short term environmental changes that might occur during a typical air conditioning cycle.

Continuing on with FIG. 3, the unoccupied temperature set point 42 returns to its original higher temperature set point value at time 48, and the humidity trace 36 is shown splitting into an unoccupied trace 50 and an occupied trace 52. Because the unoccupied temperature set point 42 returns at time 48, the average unoccupied humidity trace 50 may begin to rise shortly thereafter. The occupied temperature set point 44, however, remains lower, and may continue to drive the occupied humidity trace 52 down due to the increased run time of the air conditioner compressor. The continued downward trend of the occupied relative humidity trace 52 is illustrative of one circumstance and may, in some instances, level off or begin oscillating around a particular humidity level over time.

At time 54, the unoccupied humidity trace 50 again crosses the upper threshold 38 again, causing the unoccupied temperature set point 42 to move to the lower temperature set point again. As discussed above, this may cause a downward slope in the unoccupied humidity trace 50 a second time. The cycling of the unoccupied temperature set point 42 may be quick enough to be annoying to occupants of the inside space, but because the space is unoccupied, is of little concern. For the occupied temperature set point 44, the longer occupied period of time (e.g. $t_2$) may be set to reduce such an annoyance.

Figure 4:
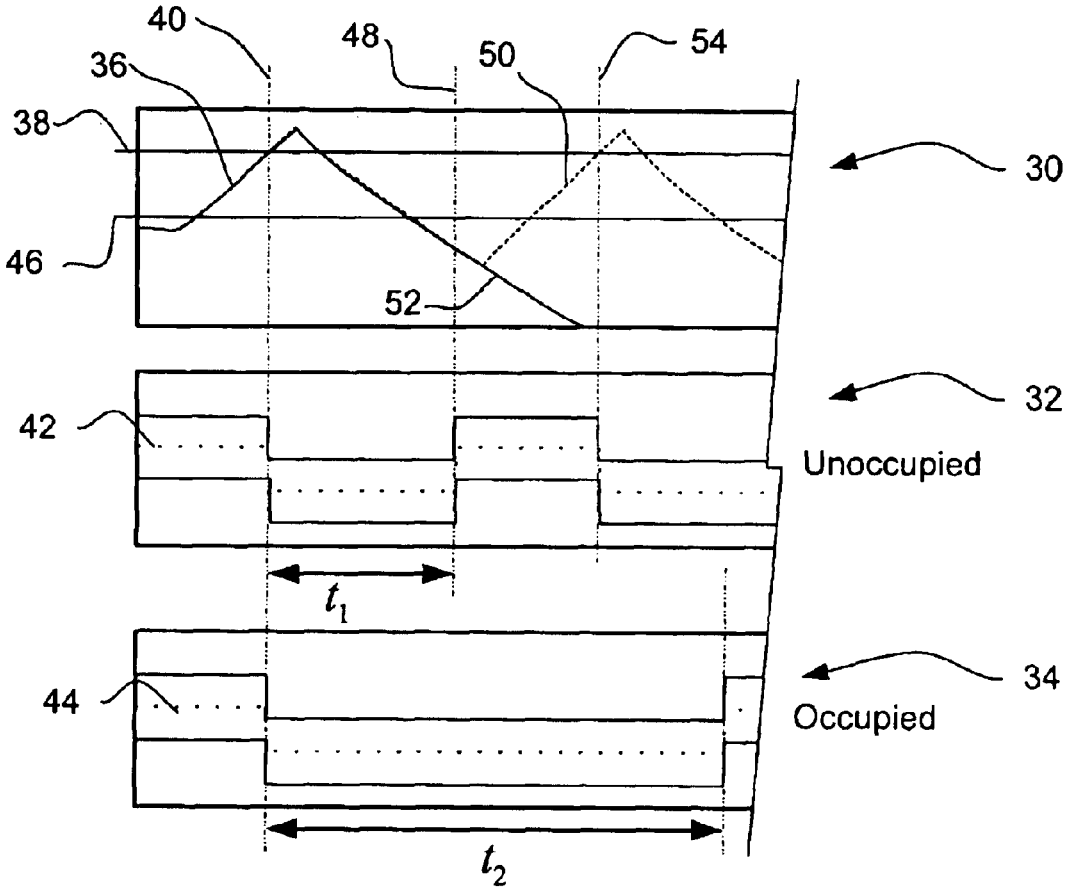
FIG. 4 is another graph illustrating set points as modified in response to changes in measured or sensed relative humidity depending on whether the controlled space is occupied or unoccupied.

FIG. 4 is another graph illustrating set points as modified in response to changes in measured or sensed relative humidity depending on whether the controlled space is occupied or unoccupied. FIG. 4 is similar to FIG. 3, except the shorter unoccupied period of time (e.g. $t_1$) and the longer occupied period of time (e.g. $t_2$) are specified relative to when the humidity level initially crosses the upper humidity threshold 38, and not when the humidity level of the inside space crosses the lower humidity threshold 46 as in FIG. 3. In either case, the shorter unoccupied period of time (e.g. $t_1$) is preferably shorter than the longer occupied period of time (e.g. $t_2$).

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A method for controlling an air conditioner that is adapted to service an inside space, the method comprising the steps of:

identifying a temperature set point for the inside space;

identifying whether the inside space is expected to be occupied or unoccupied;

determining the humidity of the inside space;

determining if the humidity level of the inside space has risen above a predetermined upper humidity threshold level;

lowering the temperature set point for a first time period if the inside space is expected to be unoccupied;

lowering the temperature set point for a second time period if the inside space is expected to be occupied; and wherein the first time period is shorter than the second time period.

2. The method of claim 1 wherein lowering of the temperature set point causes the humidity level of the inside space to drop.

3. The method of claim 2 further comprising the step of:

determining if the humidity level of the inside space has dropped below a predetermined lower humidity threshold level.

4. The method of claim 3 wherein, if the space is expected to be unoccupied, the first time period begins running when the humidity level of the inside space has dropped below the predetermined lower humidity threshold level.

5. The method of claim 4 wherein the first time period is approximately five minutes.

6. The method of claim 4 wherein, if the space is expected to be occupied, the second time period begins running when the humidity level of the inside space has dropped below the predetermined lower humidity threshold level.

7. The method of claim 6 wherein the second time period is approximately twenty minutes.

8. The method of claim 1 wherein, if the space is expected to be unoccupied, the first time period begins running when the humidity level of the inside space has risen above the predetermined upper humidity threshold level.

9. The method of claim 1 wherein, if the space is expected to be occupied, the second time period begins running when the humidity level of the inside space has risen above the predetermined upper humidity threshold level.

10. The method of claim 1 wherein the humidity level is a measure of relative humidity.

11. A system for controlling an air conditioner that is adapted to service an inside space, the system comprising:

means for storing a temperature set point for the inside space, an indication of whether the inside space is expected to be occupied or unoccupied, and a predetermined upper humidity threshold level;

one or more sensors for determining a humidity level in the inside space;

means for determining if the humidity level of the inside space has risen above the predetermined upper humidity threshold level; and means for lowering the temperature set point for a first time period if the inside space is expected to be unoccupied, and for lowering the temperature set point for a second time period if the inside space is expected to be occupied, wherein the first time period is shorter than the second time period.

12. The system of claim 11 wherein the air conditioner causes the humidity level of the inside space to drop in response to lowering the temperature set point.

13. The system of claim 12 wherein said means for determining further determines if the humidity level of the inside space has dropped below a predetermined lower humidity threshold level.

14. The system of claim 13 wherein, if the space is expected to be unoccupied, the first time period begins running when the humidity level of the inside space has dropped below the predetermined lower humidity threshold level.

15. The system of claim 14 wherein the first time period is approximately five minutes.

16. The system of claim 14 wherein, if the space is expected to be occupied, the second time period begins ruling when the humidity level of the inside space has dropped below the predetermined lower humidity threshold level.

17. The system of claim 16 wherein the second time period is approximately twenty minutes.

18. The method of claim 11 wherein, if the space is expected to be unoccupied, the first time period begins running when the humidity level of the inside space has risen above the predetermined upper humidity threshold level.

19. The system of claim 11 wherein, if the space is expected to be occupied, the second time period begins running when the humidity level of the inside space has risen above the predetermined upper humidity threshold level.

20. The method of claim 11 wherein the humidity level is a measure of relative humidity.

21. A computer-readable medium having stored thereon a computer program for controlling an air conditioner that services an inside space which, when executed by a controller, is capable of performing the following steps reading a temperature set point for the inside space;

identifying whether the inside space is expected to be occupied or unoccupied;

reading a measure of the humidity of the inside space;

determining if the humidity level of the inside space has risen above a predetermined upper humidity threshold level;

lowering the temperature set point for a first time period if the inside space is expected to be unoccupied;

lowering the temperature set point for a second time period if the inside space is expected to be occupied; and wherein the first time period is shorter than the second time period.

* * * * *